US006513919B2

(12) United States Patent
Shyn et al.

(10) Patent No.: US 6,513,919 B2
(45) Date of Patent: Feb. 4, 2003

(54) PRESSURE-COMPENSATION DEVICE OF A CARTRIDGE FOR INK JET PRINTERS

(75) Inventors: Der-Rong Shyn, Putz (TW); Chen Chih-Ching, Taipei (TW)

(73) Assignee: Acer Communications & Multimedia Inc., Taoyuan (TW)

( * ) Notice: Subject to any disclaimer, the term of this patent is extended or adjusted under 35 U.S.C. 154(b) by 0 days.

(21) Appl. No.: 09/989,164

(22) Filed: Nov. 21, 2001

(65) Prior Publication Data

US 2002/0057318 A1 May 16, 2002

(30) Foreign Application Priority Data

Dec. 8, 2000 (TW) ..... 89126299 A

(51) Int. Cl.[7] ..... B41J 2/175
(52) U.S. Cl. ..... 347/86
(58) Field of Search ..... 347/85, 86, 87; 222/105, 95

(56) References Cited

U.S. PATENT DOCUMENTS 4,509,062 A * 4/1985 Low et al. ..... 347/87
4,558,326 A * 12/1985 Kimura et al. ..... 347/30
4,883,201 A * 11/1989 Poulton ..... 222/105
5,504,511 A * 4/1996 Nakajima et al. ..... 347/86
5,541,632 A * 7/1996 Khodapanah et al. ..... 347/87
6,428,152 B1 * 8/2002 Hollands ..... 347/85
2002/0067398 A1 * 6/2002 Shyn et al. ..... 347/86

FOREIGN PATENT DOCUMENTS

DE 101 52 591 * 6/2002
GB 2 225 770 * 6/1990

* cited by examiner

*Primary Examiner*—Michael Nghiem
(74) *Attorney, Agent, or Firm*—Troxell Law Office PLLC

(57) ABSTRACT

A pressure-compensation cartridge for ink jet printers, which is able to adjust the backpressure inside the cartridge within a proper range to prevent ink leakage from the print head or failure caused by ink dropping problems. The cartridge is a sealed container with an air duct on the top and a print head on the bottom. The pressure-compensation device, located inside the cartridge, includes an ink bag, a tension spring, and a motion element. The ink bag accommodates a substantial amount of ink for the print function of the print head and is made of a soft material. The tension spring has a first end engaged with the upper end of the ink bag and a second end engaged with the motion element. The resilience of the tension spring restrains the contraction of the ink bag caused by the running off of the ink so as to maintain a stable backpressure inside the ink bag, which prevents ink leakage or ink dropping problems through the print head of the cartridge.

13 Claims, 6 Drawing Sheets

PRESSURE-COMPENSATION DEVICE OF A CARTRIDGE FOR INK JET PRINTERS

BACKGROUND OF THE INVENTION (1) Field of the Invention

The present invention relates to a pressure-compensation device of a cartridge, and more particularly to a device that can be utilized to stabilize an internal backpressure of an ink bag inside the cartridge.

(2) Description of the Prior Art

In the computer industry, an ink jet printer, one of the well-known computer peripheral devices, performs printing jobs coordinated by the computer by providing ink drops from a cartridge through a print head onto a piece of paper or other recording media.

In the art, a well-designed cartridge for ink-jet printer should comply with the following two requirements:

1. While the cartridge is at an idle state, the internal pressure Pi of cartridge should be less than the external atmosphere pressure Po to prevent the cartridge from ink leakage through the print head.
2. While the cartridge is at a printing state, an additional pressure needs to be provided to increase the internal pressure Pi of the cartridge to overcome the external atmosphere pressure Po so that the ink inside the cartridge is able to drop out through the print head and accomplish the intended printing job.

To satisfy the aforesaid first requirement, a resort in the art is to add a backpressure Pb into the cartridge to provide a minus pressure for reducing the internal pressure Pi. By maintaining the internal pressure Pi of the cartridge to be less than the external atmosphere pressure Po during reservoir's idle state, the possible ink leakage from the print head can be prevented.

On the other hand, to satisfy the aforesaid second requirement, a resolution in the art is to utilize a specific print head of thermal bubble type or piezoelectric pressure wave type, which is able to generate a proper print pressure P inside the cartridge during printing. When the printing pressure P is greater than the backpressure Pb, the internal pressure of cartridge Pi reaches a pressure level higher than the external atmosphere pressure Po so that the cartridge allows ink to drop out through the print head to perform the intended printing function. The art of print head is not within the scope of the present invention, therefore, no more efforts thereinafter will be devoted to it. The focus of the present invention is on stabilizing the internal backpressure Pb inside the cartridge to prevent the ink leakage or the fail of ink dropping problems.

Referring to FIG. 1 and FIG. 2, a conventional cartridge 10 with a pressure-compensation device 20 of U.S. Pat. No. 5,541,632 are shown respectively in an exploded view and a schematic application view. The cartridge 10 is a sealed rigid container that is constructed by an outer housing 11 and two outer covers 12, 13, and inside thereof further includes two resilient membranes 14, 15. A pressure-compensation device 20 and ink are installed inside the two resilience membranes 14, 15, where the pressure-compensation device 20 is used to maintain a proper backpressure Pb for keeping the internal pressure Pi to be less than the external atmosphere pressure Po to prevent from the ink leakage or the fail of ink dropping problems.

The pressure-compensation device 20 includes two inner covers 21, 22 and an arch spring 23, whereof outer centers of the inner covers 21, 22 are engaged respectively with the resilient membranes 14, 15, while their inner centers thereof are engaged with the arch spring 23.

Referring to FIG. 2, a free state of the arch spring 23 is presented in solid lines. As the ink inside the cartridge 10 gradually decreases along with the progression of printing operation, contractions from the two resilient membranes 14, 15 can move the inner covers 21, 22 inwards. At the same time, resilience of the arch spring 23 resists the inward movement of the inner covers 21, 22, so that the volume reduced by the two approaching resilient membranes 14, 15 is actually less than the volume loss caused by the running off of ink, by which a proper backpressure Pb can be provided inside the cartridge 10. In the art, it is the backpressure Pb that assures the proper ink supply during the printing operation and prevents the cartridge 10 from ink leaking through a print head thereof.

Nevertheless, the aforesaid pressure-compensation device 20 does exist some practical disadvantages. The major disadvantage is the stability control of the internal backpressure Pb inside the cartridge 10. Obviously, the internal backpressure Pb inside the cartridge 10 is correlated with the elastic coefficient of the arch spring 23. Yet, the aforesaid arch spring 23 is not a standardized spring, and theoretically the elastic coefficient of a perfect arch spring 23 for the cartridge 10 needs to vary along with the deformation of the spring 23 so as to provide a consistent forcing during the running off of the ink. Definitely, the arch spring 23 is not only difficult to be produced but also the varying elastic coefficient is hard to achieve. It is why instability of the backpressure usually happens to the conventional cartridge 10, which leads to possible ink leakage and failure to drop ink.

SUMMARY OF THE INVENTION

Accordingly, it is a primary object of the present invention to provide a pressure-compensation device of a cartridge for ink jet printers, which is able to adjust the backpressure inside the cartridge within a proper range to prevent the print head from the ink leakage or the fail of ink dropping problems.

The cartridge of the present invention is a sealed container with an air duct on the top and a print head on the bottom. The pressure-compensation device, located inside the cartridge, includes an ink bag, a tension spring, and a motion element.

The internal space of the ink bag is used to accommodate a substantial amount of ink for the print function of the print head. The ink bag, whose volume decreases along with the running off of ink, is made of a soft material. The tension spring, whose first end engages with the upper end of the ink bag and the second end engages with the motion element, is kept always at a tension state. As the ink inside the ink bag runs off along with the progression of printing operation, the volume of the ink bag also decreases. Simultaneously, the change of ink bag volume moves the tension spring and the motion element to maintain the tension spring at a tension state. The resilience of the tension spring restrains the contraction of the ink bag caused by the running off of ink so as to maintain a stable backpressure inside the ink bag, which prevents from the ink leakage or the fail of ink dropping problems through the print head of the cartridge.

The motion element of a first embodiment in accordance with the present invention is formed by a plurality of pulley sets, preferably by a pair of pulley sets. Each pulley set includes two fixed pulleys and a rope, whereof the two fixed pulleys are separately attached to the top and the bottom inside the cartridge, while the rope is connected with a second end of the tension spring and wound around the two fixed pulleys for rotation. A torque limiter could also be included at one fixed pulley of the two pulley sets, and therefore the fixed pulley must overcome the torque of the torque limiter in order to start rotating the pulley sets during the operation. The volume of the ink bag decreases along with the running off of ink. When the contraction force of the ink bag is greater than the torque of the torque limiter, the force can then move the tension spring and the rope simultaneously to keep the elongation of the tension spring within a proper range, and thereby a stable backpressure inside the cartridge can be induced to prevent from the ink leakage or the fail of ink dropping problems for the in jet printer.

The motion element of a second embodiment in accordance with the present invention is similar to a piston structure that includes a piston bar and a penetration hole from where the piston bar can extend to exterior of the cartridge. The piston bar is used to slide along inside the penetration hole whose internal surface can be farther coated or padded with a frictional material. When the volume of the ink bag decreases with the running off of ink and contraction of the ink bag is greater than the friction between the piston bar and the penetration hole, the ink bag moves the tension spring and the rope simultaneously to keep the deformation of the tension spring within a proper range, so that resilience of the tension spring can be induced to generate a stable backpressure inside the cartridge for preventing ink jet printers from the ink leakage or the fail of ink dropping problems.

The motion element of a third embodiment in accordance with the present invention is formed by a pulley set and a balancing weight. The pulley set includes two fixed pulleys and a rope, whereof two ends of the rope are connected respectively with the balancing weight and the ink bag. In this embodiment, the weight of the balancing weight becomes a drawing force acting upon the ink bag through the rope to restrain the contraction of the ink bag and to induce a required proper backpressure.

When the volume of the ink bag decreases with the running off of ink and the contraction force of the ink bag is greater than the weight of the balancing weight, the rope and the balancing weight can be moved simultaneously. In the present invention, it is noted that the force of the balancing weight acting upon the ink bag can be maintained steady at any stage, and thus the backpressure inside the ink bag is maintained at a stable state no matter how much ink remains in the ink bag. Up such an arrangement, the ink leakage or the fail of ink dropping problems can be avoided.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a pressure-compensation device of a cartridge for ink jet printers. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
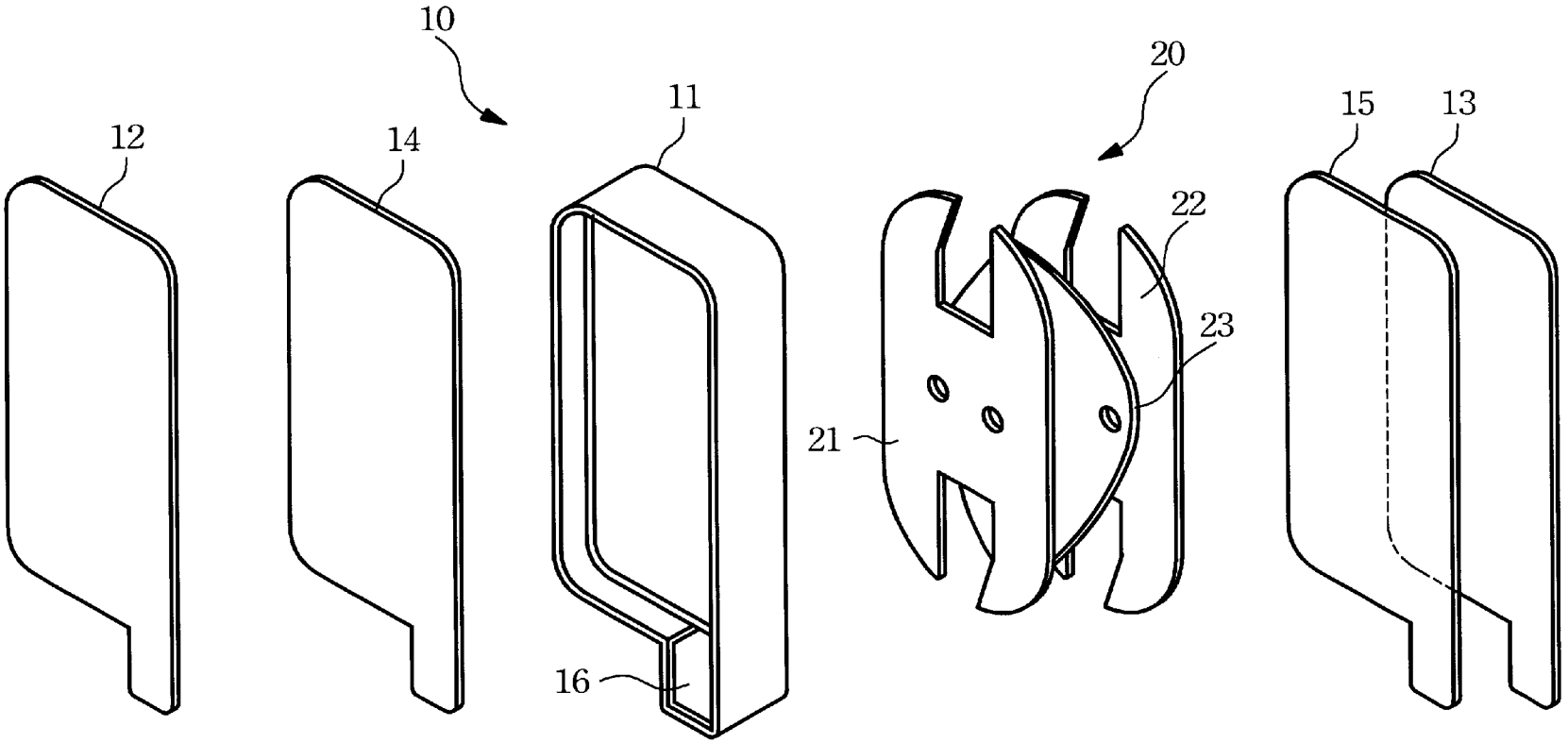
FIG. 1 (Prior Art)
FIG. 1 is a schematic view of a prior pressure-compensation device of a cartridge.
Figure 2:
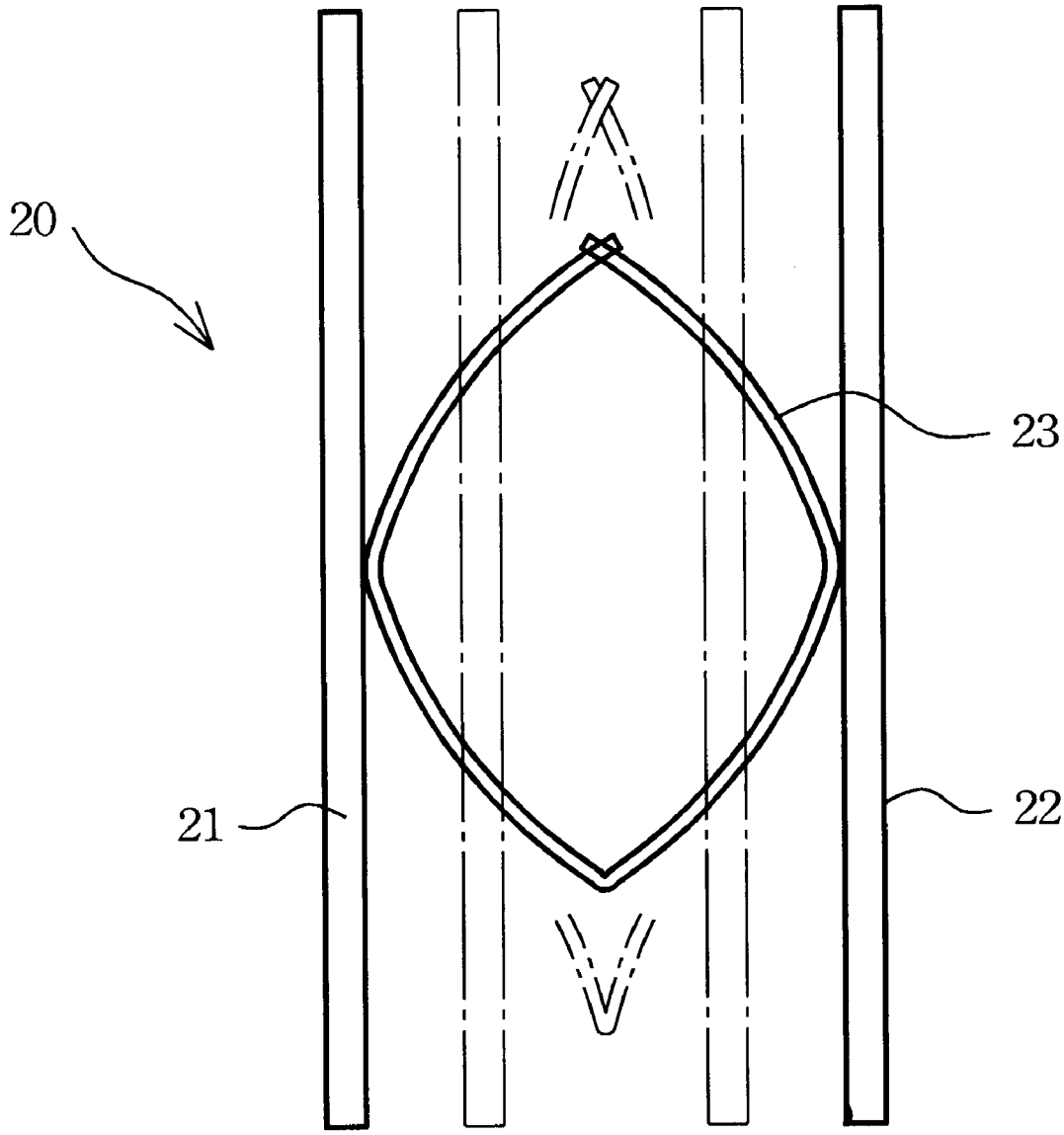
FIG. 2 (Prior Art)
FIG. 2 is a schematic view of the prior pressure-compensation device of FIG. 1.
Figure 3B:
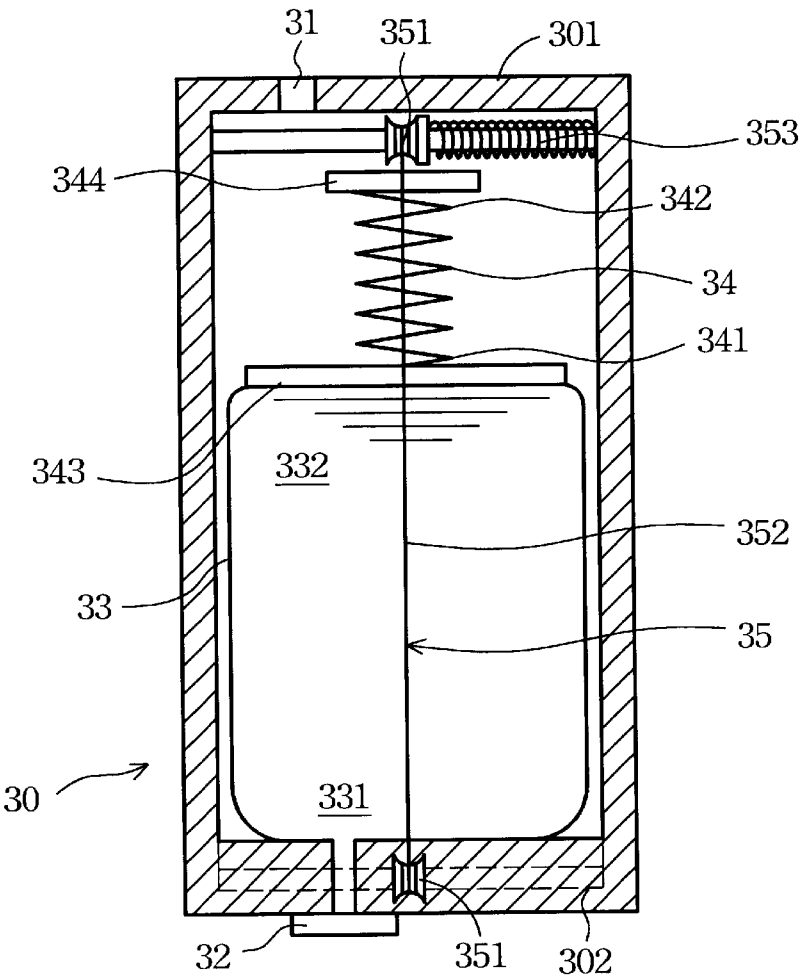
FIG. 3B is a schematic side cross-sectional view of the first embodiment of FIG. 3A.
Figure 3A:
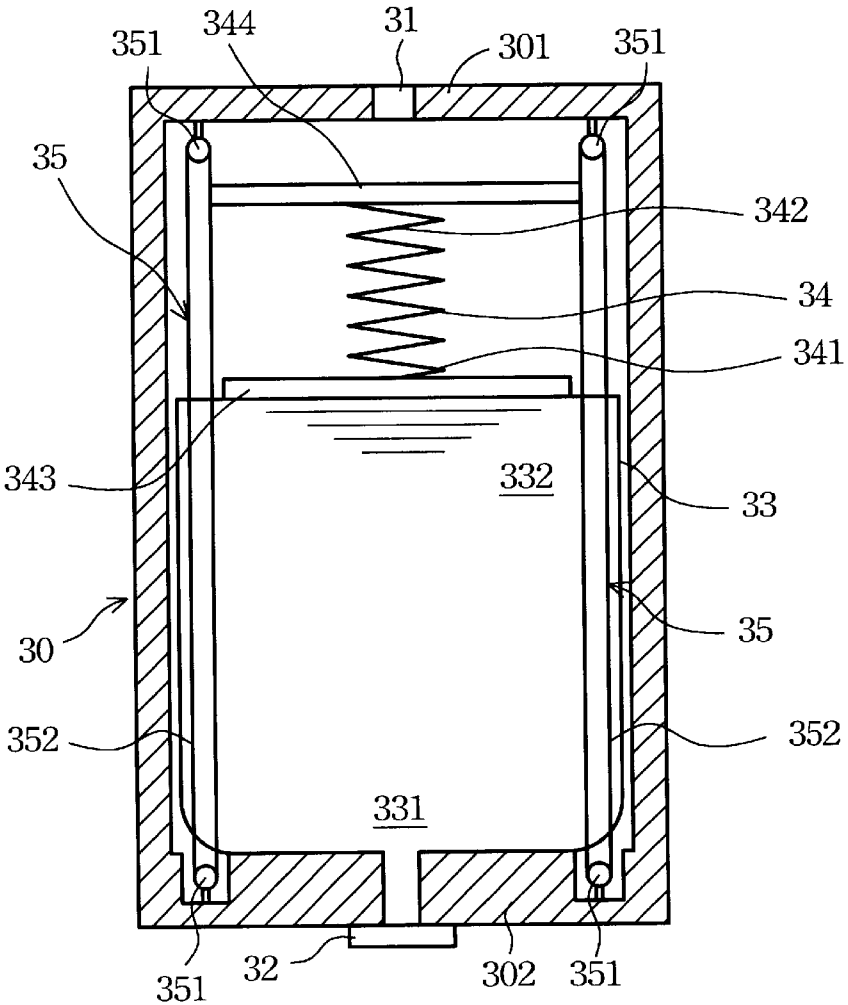
FIG. 3A is a schematic front cross-sectional view of a first embodiment of the pressure-compensation device.

Referring now to FIG. 3A and FIG. 3B, two different views of a first embodiment of the pressure-compensation device of a cartridge for ink jet printers in accordance with the present invention are shown, whereof FIG. 3A is the front cross-sectional view of the first embodiment while FIG. 3B the side cross-sectional view. The cartridge 30 is a sealed container with an air duct 31 on the top 301 and a print head 32 on the bottom 302. The pressure-compensation device, located inside the cartridge 30, includes an ink bag 33, a tension spring 34, and a motion element 35.

Figure 3C:
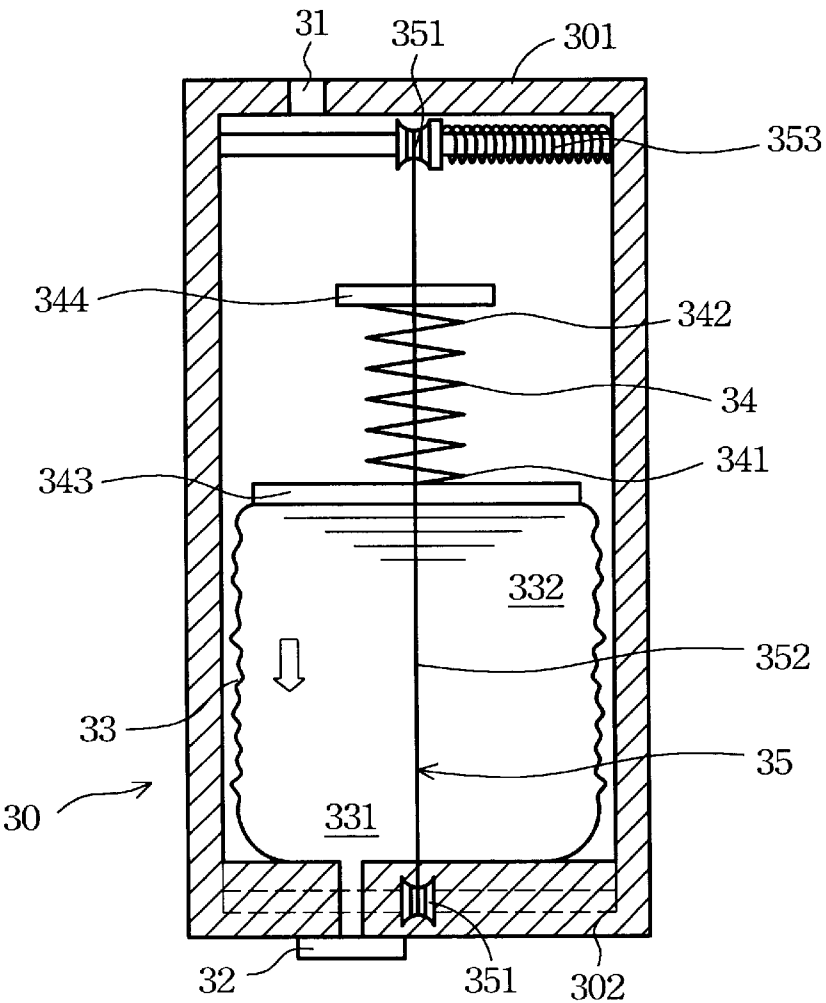
FIG. 3C is a schematic cross-sectional view showing an ink consumption state of the ink bag in comparison with a full ink state shown in FIG. 3B.

The ink bag 33 is used to accommodate a substantial amount of ink for performing the printing of the print head 32. The ink bag 33 can be made of a soft elastic material, whose volume can decrease along with the running off of ink. The bottom portion 331 of the ink bag 33 is adhered to the bottom 302 of the cartridge 30, and so the volume of the ink bag.33 is retreated from top to bottom as the arrow direction shown in FIG. 3C.

The tension spring 34 includes a first end 341 and a second end 342, further attaching respectively a disk 343 and another disk 344. The tension spring 34 connects with the top 332 of the ink bag 33 at the first end 341 and the motion element 35 at the second end 342, by which the tension spring 34 can be always kept at a tension state to provide resilience for drawing the ink bag 33 upwards and thus for retraining the contraction of the ink bag 33 to induce a proper backpressure Pb inside the ink bag 33 for preventing the print head 32 from ink leakage.

The motion element 35 is formed by a plurality of pulley sets, preferably in two or four pulley sets. Take a two-pulley-set as an example in the following. Each pulley set can include two fixed pulleys 351 and a rope 352, whereof these two fixed pulleys 351 are separately located on the top 301 and the bottom 302 inside the cartridge 30, and whereof the rope 352 is wound around the fixed pulleys 351 for co-rotation and is also connected with the disk 344 on the second end 342 of the tension spring 34. In this embodiment, a torque limiter 353 can be added at one fixed pulley 351 of the pulley sets(not shown in FIG. 3A), and the fixed pulley 351 must overcome the friction torque of the torque limiter 353 to start rotating the pulley sets.

When the contraction force of the ink bag 33 is greater than the friction torque of the torque limiter 353, the ink bag 33 can then move the rope 352 through the tension spring 34 downwards. Upon such an arrangement, action against the contraction of the ink bag 33 can be shared by the pulley sets and the tension spring 34, so that the elongation of the tension spring 34 as well as the induced backpressure upon the ink bag 33 can be restrained to be within a proper range. According to the present invention, resilience provided by the elongated tension spring 34 can thus induce a stable backpressure Pb inside the ink bag 33 to compensate the contraction of the ink bag 33 for smoothly feeding the ink during a printing job till the ink thereinside runs off completely.

Figure 4:
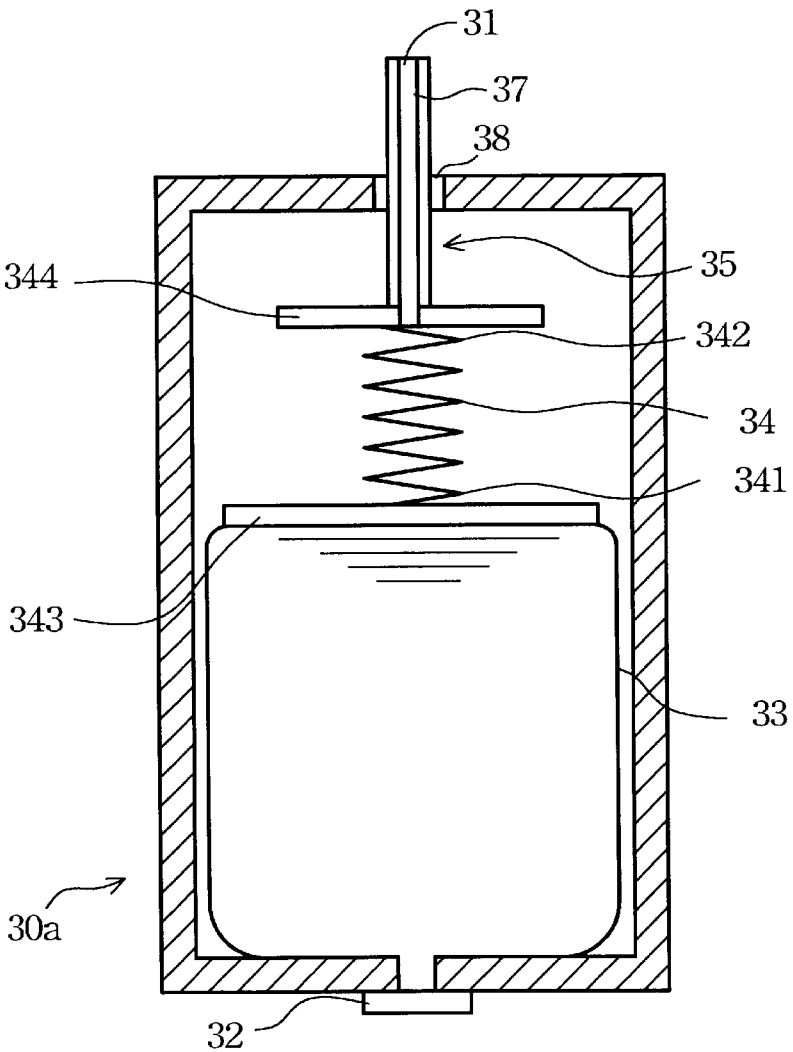
FIG. 4 is a schematic cross-section view of a second embodiment in accordance with the present invention.

Please refer to FIG. 4, showing a second embodiment of the pressure-compensation device of a cartridge for ink jet printers in accordance with the present invention. Besides the motion element 35, most elements of the second embodiment are similar both in structure and in function to those of the first embodiment. The common elements are given the same numerical orders and won't be discussed further in the following, while the element performing the same function but with different structural design is suffixed by an "a" for distinguishing.

The motion element 35 of the embodiment is similar to a piston structure that includes a piston bar 37 and a penetration hole 38. The piston bar 37 plugs into the penetration hole 38 whose internal surface can be further coated or padded with a frictional material. In this embodiment, the piston bar 37 must overcome the maximum static friction in between with the penetration hole 38 to start sliding.

When the volume of the ink bag 33 decreases with the running off of ink to a state that the contraction force is greater than maximum static friction between the piston bar 37 and the penetration hole 38, the ink bag 33 can then move the tension spring 34 and the motion element 35 (piston bar 37) downwards to keep the elongation of the tension spring 34 within a proper range, by which the internal backpressure Pb inside the ink bag 33 can also be maintained at a stable state. Therefore, no matter how much ink is left inside the ink bag 33, leaking out of the ink due to under-backpressure Pb or drop-out failure due to over-backpressure Pb can be avoided.

Figure 5:
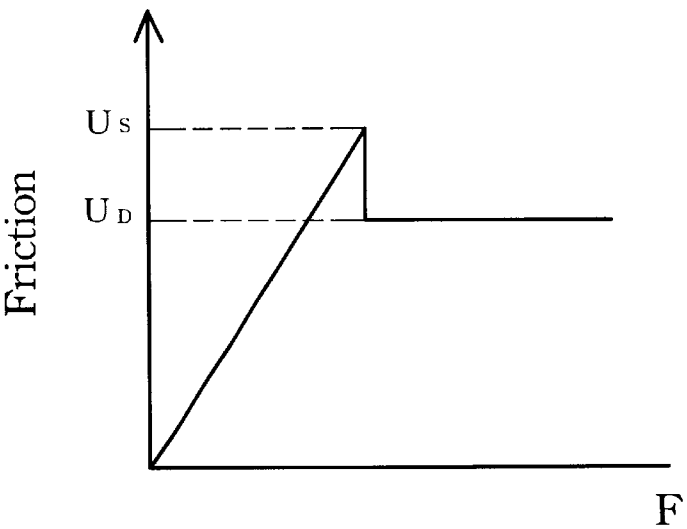
FIG. 5 shows the relationship between the acting force and the reacting friction of the motion element in accordance with the present invention.
Figure 6B:
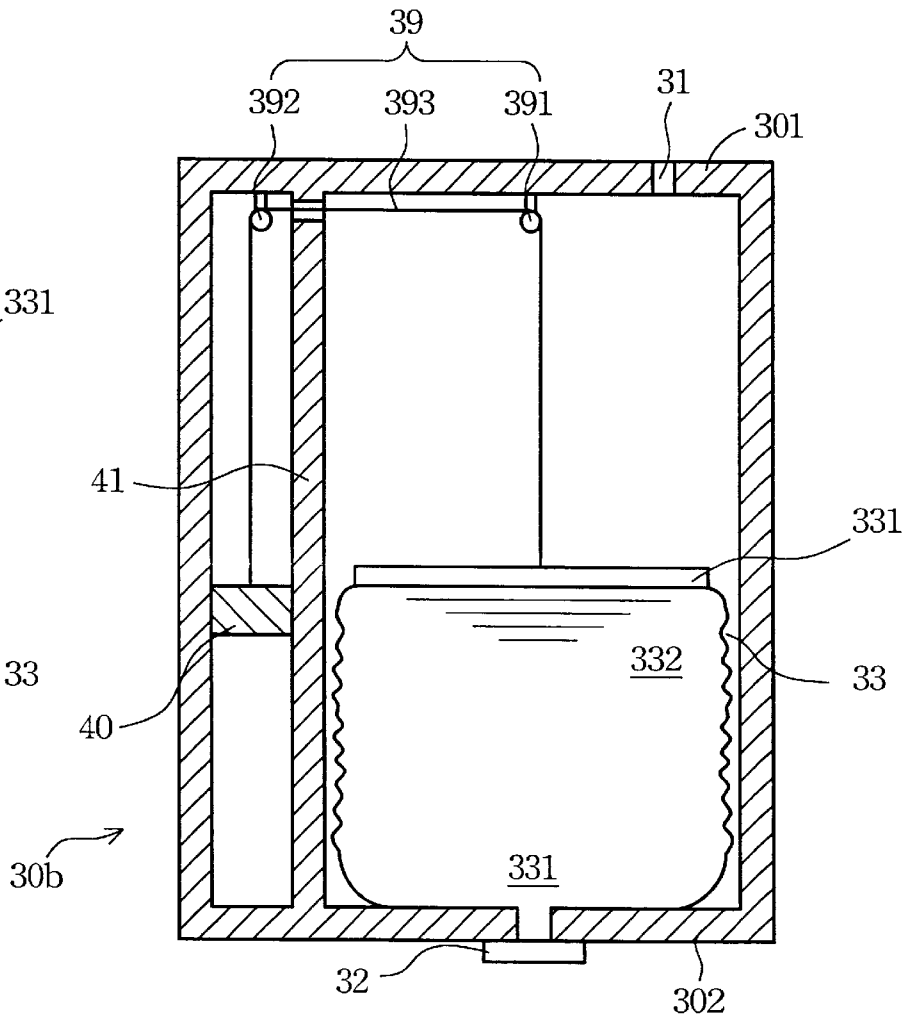
FIG. 6B is a schematic cross-sectional view showing an ink consumption state in comparison with a full ink state in FIG. 6A.
Figure 6A:
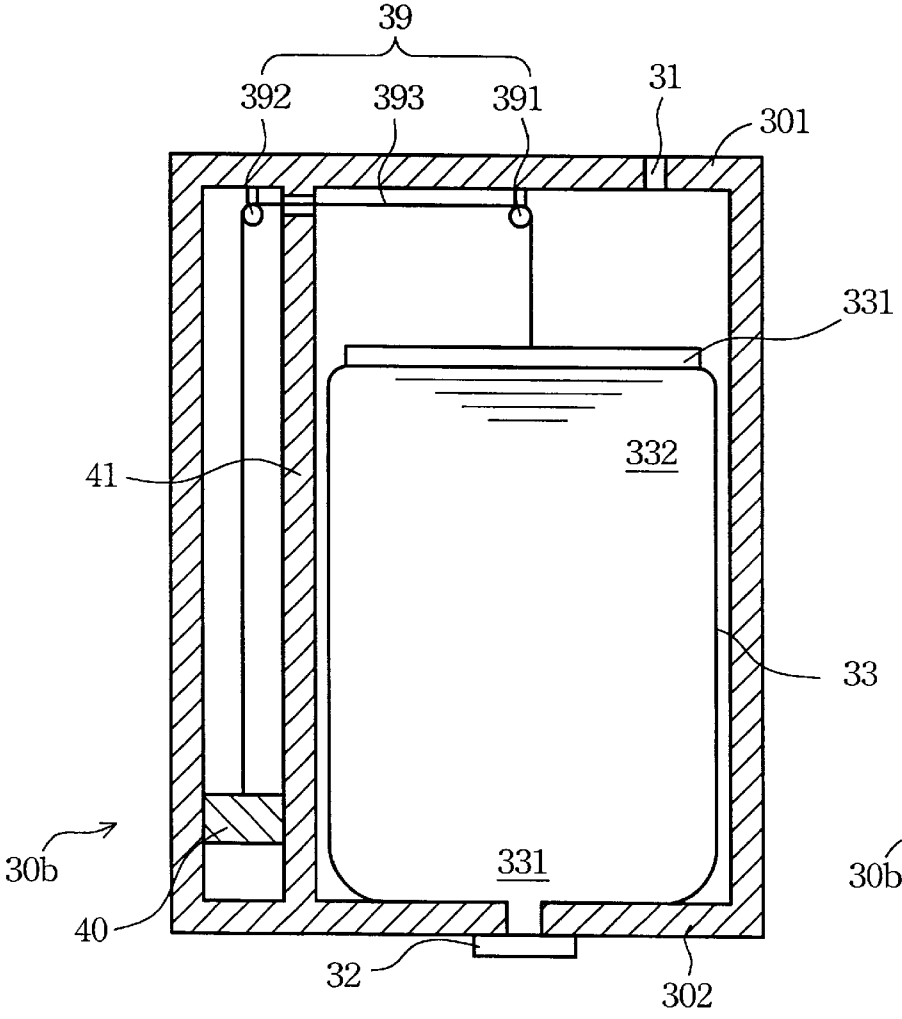
FIG. 6A is a schematic cross-sectional view of a third embodiment of in accordance with the present invention.

Please refer to FIG. 5, a relationship figure between the acting force (F) and the friction of the motion element. In the two aforesaid embodiments, the acting force of the motion element must overcome the friction (Us) to move the motion element, whereof the friction (Us) in the first embodiment is the friction torque of the torque limiter, while in the second embodiment is the maximum static friction between the piston bar and the penetration hole. Please refer to FIG. 6A and FIG. 6B, showing a third embodiment of the pressure-compensation device of a cartridge 30*b* for ink jet printers in accordance with the present invention. The pressure-compensation device of the embodiment includes an ink bag 33, a pulley set 39, and a balancing weight 40.

The ink bag 33 whose internal space accommodates a substantial amount of ink is located inside the cartridge 30*b*. The ink bag 33 is made of an elastic material, whose volume decreases along with the running off of ink. The bottom portion 331 of the ink bag 33 is adhered to the bottom 302 of the cartridge 30*b*, and a disk 331 is located on top 332 of the ink bag 33. As the volume of the ink bag 33 decreases along with the running off of ink, the top 332 of the ink bag 33 moves downwards to approach the bottom 331 thereof.

The pulley set 39 includes a first fixed pulley 391, a second fixed pulley 392, and a rope 393. As shown, both the first fixed pulley 391 and the second fixed pulley 392 are mounted at the top 301 of the cartridge 30*b*, whereof the first fixed pulley 391 is located right above the ink bag 33 while the second fixed pulley 392 right on top of the balancing weight 40. The rope 393 wound through the first fixed pulley 391 and the second fixed pulley 392 has one end thereof connected with the balancing weight 40 while another end thereof with the disc 331 on top of the ink bag 33. To prevent from possible interference between the balancing weight 40 and the ink bag 33, a division 41 is provided inside the cartridge 30*b*, by which the balancing weight 40 and the ink bag 33 can be located separately at opposing sides of the division 41. The gravity of the balancing weight 40 becomes an upward drawing force acting upon the ink bag 33 through the rope 393, which can restrain the contraction of ink bag 33 and so as to induce a proper backpressure Pb.

While the volume of the ink bag 33 decreases with the running off of ink to a state that the contraction force of the ink bag 33 is greater than the weight of the balancing weight 40, the rope 393 will be pulled by the contraction force to lift the balancing weight 40 as shown in FIG. 6B. Upon such an arrangement, the counter force that the balancing weight 40 provides a constant force against the ink bag 33, so that the backpressure Pb inside the ink bag 33 can be kept constant. That is to say no matter how much ink is left inside the ink bag 33, the internal backpressure Pb can be maintained at a stable state and the ink leakage or the fail of ink supply problems can be avoided.

According to the present invention, the aforesaid pulley set 39 can be substituted by a support like a pulley, a pin, or a shaft, as long as the rope 393 is able to pass by the support and connect with the ink bag 33 as well as the motion element 35 to fulfill the goal of adjusting backpressure.

It is also understood that the air duct conduct in the present invention is not necessary to be in the top, any location that performs the function of a ventilation means to the atmosphere can achieve the same result.

As described above, the pressure-compensation device of a cartridge for ink jet printers in accordance with the present invention has at least the following advantages:

a. The pressure-compensation device of the present invention maintains the backpressure inside the ink bag within a proper range to prevent from the ink leakage or the fail of ink dropping problems.

b. The pressure-compensation device of the present invention assures the backpressure inside the ink bag not to change along with the running off of ink so that the print head of the cartridge is able to proceed its intended printing function.

c. The structural design of the pressure-compensation device of the present invention is simply constructed, so its fabrication is easy to achieve.

While the present invention has been particularly shown and described with reference to a preferred embodiment, it will be understood by those skilled in the art that various changes in form and detail may be without departing from the spirit and scope of the present invention.

We claim:

1. A pressure-compensation device, used to adjust internal backpressure of an ink bag containing ink for use in an ink-jet printer, comprising:

a motion element, moving along an axial direction of said ink bag; and a resilient element, having a constant elastic coefficient, bridging said ink bag and said motion element and being capable of extending along said axial direction to provide resilience for keeping said ink bag at a tension state whereby, as a volume of said ink bag decreases, said resilient element moves said motion element so as to provide a respective elongation thereof for restraining contraction of said ink bag and thus maintains said internal backpressure of said ink bag, wherein said device and said bag are located inside a cartridge that includes an air duct for communicating an inside of the cartridge with the atmosphere.

2. The pressure-compensation device according to claim 1 further comprising a disk located between said resilient element and said ink bag for assuring said ink bag changes volume smoothly along said axial direction.

3. The pressure-compensation device according to claim 1 further comprising a disk located between said resilient element and said motion element for guiding said motion element to move smoothly along said axial direction.

4. The pressure-compensation device according to claim 1, wherein said motion element includes a pulley set.

5. The pressure-compensation device according to claim 4, wherein said pulley set further includes two fixed pulleys and a rope, said two fixed pulleys being located respectively on a top and on a bottom thereof inside said cartridge and at least one of said fixed pulleys having a torque limiter, where resilience of said ink bag overcomes a friction torque of said torque limiter so as to move said rope and said resilient element simultaneously.

6. The pressure-compensation device according to claim 4, wherein said pulley set includes four fixed pulleys.

7. The pressure-compensation device according to claim 4, wherein said pulley set includes a plurality of fixed pulleys.

8. The pressure-compensation device according to claim 1, wherein said motion element is a piston structure further including a piston bar and a penetration hole in said cartridge for allowing said piston bar to slide along thereinside, said penetration hole having an internal surface coated with a frictional material, whereby a contraction force of said ink bag overcomes friction between said piston bar and said penetration hole so as to move said tension spring and said rope simultaneously.

9. A pressure-compensation device for adjusting an internal backpressure inside an ink bag in an atmosphere environment, said ink bag containing ink for the use of ink jet printers, comprising:

a motion element, moving along an axial direction of said ink bag; and a connecting element bridging said ink bag and said motion element enabling said ink bag to be extended by a weight of said motion element, said connecting element moving said motion element to maintain said internal backpressure of said ink bag as said ink bag decreases in volume along with running off of said ink.

10. The pressure-compensation device according to claim 9, wherein said device and said ink bag are located inside a cartridge that includes an air duct for communicating an inside of the cartridge with the atmosphere.

11. The pressure-compensation device according to claim 10, wherein said cartridge further includes a division plate, and said motion element and said ink bag are located respectively on opposite sides of said division plate so as to prevent interference between movements of said ink bag and said motion element.

12. The pressure-compensation device according to claim 9, wherein the top of said ink bag further includes a disk to assure the smooth axial contraction and extension of the said ink bag.

13. The pressure-compensation device according to claim 9, wherein said connecting element further includes two fixed pulleys and a rope, said rope being wound around said fixed pulleys and connected to said ink bag and to said motion element.

* * * * *

UNITED STATES PATENT AND TRADEMARK OFFICE

CERTIFICATE OF CORRECTION

PATENT NO. : 6,513,919 B2
DATED : February 4, 2003
INVENTOR(S) : Der-Rong Shyn et al.

It is certified that error appears in the above-identified patent and that said Letters Patent is hereby corrected as shown below:

Title page,
Item [73], should read as follows:

-- [73] Assignee: Benq Corporation, Taoyuan (TW) --

Signed and Sealed this

Second Day of September, 2003

JAMES E. ROGAN
*Director of the United States Patent and Trademark Office*